United States Patent [19]

Riesen

[11] Patent Number: 4,625,769

[45] Date of Patent: Dec. 2, 1986

[54] GUIDE DEVICE FOR A WEFT PICKING ELEMENT AND A METHOD OF MAKING SAME

[75] Inventor: Peter Riesen, Elgg, Switzerland

[73] Assignee: Sulzer Brothers Limited, Winterthur, Switzerland

[21] Appl. No.: 772,638

[22] Filed: Sep. 5, 1985

[30] Foreign Application Priority Data

Sep. 13, 1984 [EP] European Pat. Off. ..... 84110954.9

[51] Int. Cl.[4] ..... D03D 49/66

[52] U.S. Cl. ..... 139/188 R; 139/439

[58] Field of Search ..... 139/435, 188, 191, 192, 139/439

[56] References Cited

U.S. PATENT DOCUMENTS

| | | | |
|---|---|---|---|
| 3,556,163 | 1/1971 | Pfarrwaller | 139/188 |
| 3,667,508 | 6/1972 | Inglin | 139/188 |
| 4,319,611 | 3/1982 | Foltyn et al. | 139/435 |
| 4,452,283 | 6/1984 | Koch | 139/192 |

FOREIGN PATENT DOCUMENTS

| | | | |
|---|---|---|---|
| 66544 | 4/1984 | Japan | 139/435 |
| 66545 | 4/1984 | Japan | 139/435 |

*Primary Examiner*—Henry S. Jaudon

*Attorney, Agent, or Firm*—Kenyon & Kenyon

[57] ABSTRACT

The guide device for the picking element of the weaving machine is formed with guide teeth each of which has a flexible zone which permits a positional adjustment of the guide and support member and guide hook relative to one another. During production of the guide device, the guide and support member and guide hook of each tooth are pressed against a gauge rod by a pressing device and thereafter potted in resin which forms a block. The presence of the gauge rod ensures a precisely tubular guide channel so that the path for a picking element is very regular.

18 Claims, 8 Drawing Figures

GUIDE DEVICE FOR A WEFT PICKING ELEMENT AND A METHOD OF MAKING SAME

This invention relates to a guide device for a weft picking element of a weaving machine and to a method of making the guide device.

As as known, weaving machines, particularly gripper projectile weaving machines, have been provided with a guide device for guiding a weft picking element. In many cases, the guide device has been formed of a plurality of guide teeth, each of which includes a guide and support member and a guide hook which defines a guide channel for the picking element through the guide device. Usually, the teeth with interposed spacers have been mounted in side-by-side relation on the sley beam of the weaving machine. Although the guide teeth have been manufactured to very close tolerances, the guide channel bounded by the teeth has not been precisely tubular. Hence, the guide path for a picking element passing through the channel has been uneven. As a result, the guide teeth and the picking elements have been subjected to rapid wear. Further, the material abrasion and possible burring of the guide teeth can impair the quality of the woven fabric.

It has also been known from German patent No. 1 801 043 to construct guide teeth with each of a guide and support member and a guide hook having a flexible zone near a transition to a tooth base in order to damp tooth movements caused by forces created by a picking element. However, such guide teeth when assembled into a guide device have the same disadvantage as above.

Accordingly, it is an object of the invention to provide a guide device which has guide teeth which form a precisely tubular guide channel for a weft picking element.

It is another object of the invention to provide a guide device formed of guide teeth which have a minimal clearance from the picking element which is to be guided through the device.

It is another object of the invention to provide a relatively simple technique for forming a guide device to precisely controlled tolerances.

Briefly, the invention provides a guide device for a weft picking element of a weaving machine which is composed of a plurality of aligned guide teeth which define a guide channel for the picking element. In accordance with the invention, each guide tooth has a guide and support member, a guide hook spaced from the member to define a guide opening, a base and a zone in the base between the member and hook in order to permit positional adjustment of the member and the hook relative to each other.

The guide device also has a means securing each base of each tooth therein with the guide and support member and the hook of each tooth in precisely fixed relation to each other.

In one emodiment, the zone in the base of each guide element is a flexible zone. For example, the base is provided with a recess which divides the base into two halves and which extends toward the guide opening so that the zone is disposed between the recess and the guide opening. As an alternative, the recess may extend from the guide opening so that the adjustment zone is disposed between the two halves of the base, for example, at the end of the base.

In still another embodiment, the base may be provided with a recess and a deformable web which bridges the recess.

In another embodiment, the guide teeth may be made in a composite manner. For example, each guide tooth may be formed with a guide and support member which includes a base and a separate guide hook which includes a base. In this embodiment, means are provided to define a zone in the two bases in order to permit positional adjustment of the guide and support member and the guide hook relative to each other. This means may include a bore in each base and a circular rod which extends through each bore in order to define a pivot zone for pivoting of either or both of the guide and support member and guide hook about the rod.

In still another embodiment, the means for defining the pivot zone may include a circular recess in the end of each base for receiving a rod to permit pivoting of the guide and support member and guide hook relative to each other.

In still another embodiment, the means defining the adjustment zone between the guide and support member and the guide hook of a composite tooth may include an articulated joint between the bases. For example, a joint may be formed by a projection on one base and a mating recess on the other base.

The invention also provides a method of making a guide device. In this respect, the method includes the steps of obtaining a plurality of guide teeth of one of the above described embodiments and a gauge rod having a cross-section of a size greater than the guide opening of a respective tooth by an amount of a clearance between the guide opening and a picking element to be guided therethrough. Thereafter, the guide teeth and interposed spacers are positioned in alignment with the gauge rod passing through the aligned guide openings and with each support member and each guide hook abutting the rod. Thereafter, the bases of the aligned guide elements are potted in a resin. After the resin has been cured, the gauge rod is removed.

In the event that a guide tooth includes a recess in the base which extends from the guide opening, a wedge is introduced into each recess after positioning of the gauge rod in order to fix the position of the support member and the hook of each tooth relative to each other.

The potting of the guide elements brings about a fixed relationship between the guide and support member and the guide hook of each tooth relative to the gauge rod. Hence, when the rod is removed, a precisely tubular guide channel is provided through which a picking element may be subsequently passed. Further, since the guide opening in each guide tooth is precisely fixed, the clearance between a picking element which is subsequently picked and the guiding surfaces of the guide teeth can be at a minimum.

These and other objects and advantages of the invention will become more apparent from the following detailed description taken in conjunction with the accompanying drawings wherein.

Figure 1:
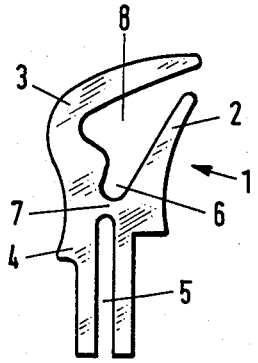
FIG. 1 illustrates a side view of a full guide tooth constructed in accordance with the invention.

Referring to FIG. 1, the guide tooth 1 for a projectile guiding device is constructed with a guide and support member 2, a guide hook 3 and a base 4 which is common to and which connects the member 2 and hook 3. The member 2 and the hook 3 are spaced from each other in order to define a guide opening 8 for the passage of a picking element such as a projectile. In addition, the base 4 has a recess 5 which divides the base 4 into two halves and which extends toward the guide opening 8.

A zone 7 is also formed in the base 4 between the member 3 and hook 2 in order to permit positional adjustment of the member 2 and the hook 3 relative to each other. As indicated, this zone 7 is formed by a small amount of material which is disposed between the recess 5 in the base 4 and a trough 6 disposed between the support member 2 and guide hook 3.

The guide tooth 1 may normally be produced as a stamping.

Figure 2:
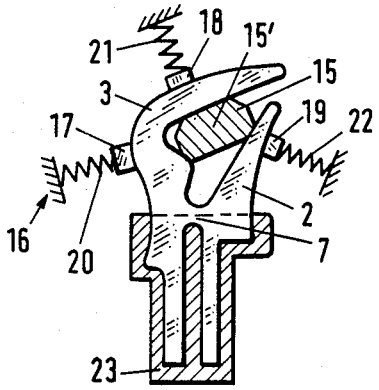
FIG. 2 illustrates a part cross-sectional view of a guide device employing the tooth of FIG. 1 during production.

Referring to FIG. 2, in order to form a guide device for a picking element, a plurality of guide teeth are positioned with interposed spacers in alignment with a gauge rod 15 passing through the aligned guide openings of each tooth. For example, the number of guide teeth for a section or part of the guide device are threaded on the gauge rod 15 with the interposition of the spacers.

As indicated, the cross-section 15′ of the rod 15 is of a size greater than the guide opening of each tooth by an amount of clearance between the guide opening and a picking element to be guided therethrough.

Thereafter, the complete assembly is then placed in a clamping or pressing device 16 in which pressing blocks 17, 18, 19, urged by springs 20, 21, 22, press the guide teeth into clearance-free engagement or abutment with the rod 15. This is possible due to the flexible zone 7 of each tooth which serves as an adjustment zone for the position and dimensions of the guide openings 8.

Thereafter, the bases of the aligned teeth are secured together by means which serve to precisely fix the relation of the support member 2 and guide hook 3 of each tooth to each other. For example, the bases 4 of the aligned guide teeth 2 are potted in a resin to form a block 23. After the resin has cured, the gauge rod 15 is removed.

The resulting guide device thus has a guide channel formed by the individual guide openings 8 of the guide teeth 1 which is precisely tubular for the passage of a picking element therethrough.

As an alternative step, the guide teeth may first be placed one beside another in the clamping device 16 with the gauge rod 15 thereafter being pushed into the aligned guide openings 8.

Figure 3:
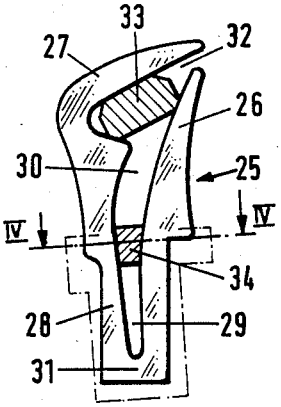
FIG. 3 illustrates a modified guide tooth employing a wedge in accordance with the invention.

Referring to FIG. 3, each guide tooth 25 may be formed with a guide and support member 26, a guide hook 27 and a base 28 which is provided with a recess 29 which extends from a guide opening 32 between the member 26 and hook 27. As indicated, the recess 29 extends from a trough 30 below the guide opening 32 and forms a continuation of the trough 30. In this embodiment, a readily deformable zone 31 is disposed between the two halves of the base 28 at the bottom end of the base 28.

Informing a guide device of a plurality of guide teeth 25, the required number of guide teeth are threaded, with the interposition of spacers, onto a gauge rod 33. The guide and support members (26) and the guide hooks (27) are thereafter abutted without clearance against the gauge rod 33 in a pressing device as described above with respect to FIG. 2.

Figure 4:
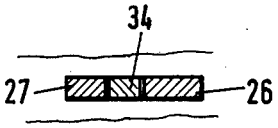
FIG. 4 illustrates a view taken on line IV–IV of FIG. 3.

Referring to FIGS. 3 and 4, during assembly of a guide device employing the guide teeth 25, a wedge 34 is introduced by way of the trough in each tooth 25 in order to define the position of the guide opening 32. As indicated in FIG. 3, the wedge 34 also serves to separate the recess 29 from the trough 30. Thereafter, the bases 28 of each guide tooth 25 are potted in resin to form a block. As indicated in dotted line, the resin block encompasses each base 28 as well as a major portion of each wedge 34.

Figure 5:
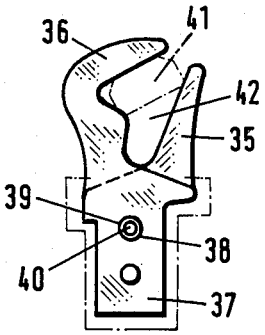
FIG. 5 illustrates a side view of a composite guide tooth constructed in accordance with the invention.

Referring to FIG. 5, each guide tooth may be a composite guide tooth formed of a discrete guide and support member 35 and a discrete guide hook 36 which cooperate with one another to form the guide tooth.

As indicated in FIG. 5, the support member 35 is provided with a base (indicated in dotted line) while the guide hook 36 has a base 37 of similar shape. In addition, a means is provided in the bases which permits positional adjustment of the member 35 and hook 36 relative to each other. That is, a bore 38, 39 is formed in each of the two bases and a circular rod 40 extends through each bore in order to define a pivot for pivoting of the member 35 and hook 36 about the rod 40.

In order to form a guide device, a plurality of composite guide teeth are threaded onto the rod with the interposition of spacers (not shown). Thereafter, a gauge rod 41 is pushed into the guide openings 42 causing the members 35 hooks 36 to rotate about the rod 40 clockwise and counter-clockwise respectively until all are in engagement with the rod 40. In this regard, a clamping device as described above with respect to FIG. 2 may be used for pivoting of the members 35 and hooks 36 on the rod 40. Thereafter, the assembly is potted in resin, as above, and the gauge rod 41 removed after curing. As indicated in dotted line, the potting resin forms a block which encompasses the bases of each tooth.

Figure 6:
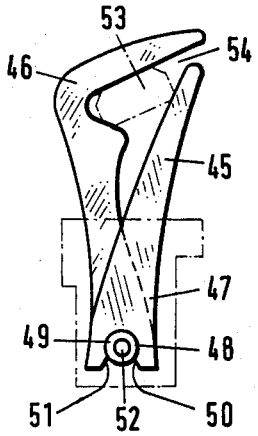
FIG. 6 illustrates a modified composite guide tooth constructed in accordance with the invention.

Referring to FIG. 6, a composite guide tooth may also be formed with a guide and support member 45 and guide hook 46, each of which has a base in a base zone 47. In addition, the pivot zone between the member 45 and hook 46 may be formed by a circular recess 48, 49 in the respective bases, each of which widens towards the bottom edge of the base into a trapezoidal part 50, 51. As above, the pivot zone also includes a circular rod 52 which extends through each recess 48, 49 for pivoting of the member 45 and hook 46 thereabout.

In order to assemble a guide device, the members 45 and hooks 46 of the guide teeth are pushed onto the rod 52 in the manner of a snap connection. Thereafter, a gauge rod 53 is pushed into the guide openings 54. Thereafter, using a clamping device as described in FIG. 2, the members 45 and hooks 46 are biased against the gauge rod and the base zone 47 of each tooth is potted in resin as above.

Figure 7:
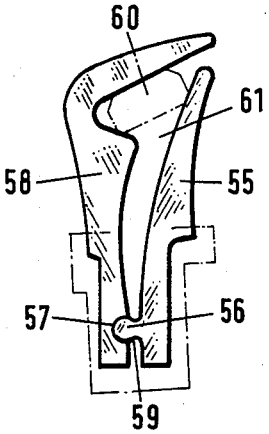
FIG. 7 illustrates a further modified composite guide tooth having an articulated joint in accordance with the invention.

Referring to FIG. 7, a composite guide tooth may also be constructed with a guide and support member 55, a guide hook 58 and an articulated joint 59 which serves as a means to define an adjustment zone in the bases of the member 55 and hook 58. For example, the joint may be formed by a projection 56 on the base of the support member 55 and a mating recess 57 in the base of the hook 58.

In order to assemble a guide device of the articulated elements 55, 58, the articulated elements 55, 58 are introduced into a clamping device, as above, with the interposition of spacers. A gauge rod 60 is then pushed into the guide opening 61 of each tooth so that the members 55 and hooks 58 pivot at the articulated joint 59 to engage the rod 60 without clearance. Thereafter, the bases of the elements 55, 58 are potted in resin, as above.

Figure 8:
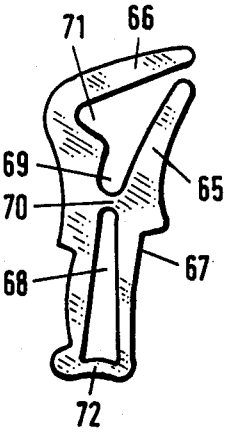
FIG. 8 illustrates a side view of a further modified full guide tooth constructed in accordance with the invention.

Referring to FIG. 8, a full guide tooth may be formed in similar manner to that illustrated in FIG. 1. In this respect, the guide tooth has a guide and support member 65, a guide hook 66 and a base 67 connecting the member 65 and hook 66. In addition, the base 67 is formed with an elongated recess 68 which extends from below a trough 69 so as to define a flexible zone 70 to a deformable web 72 which bridges across the recess 68. As indicated, the web 72 is of a narrow curved shape so as to be readily stretchable. The nature of the web 72 is such that when a gauge rod is placed in a guide opening 71 between the member 65 and hook 66, the web 72 is deformed along with the flexible zone 70. However, the web 72 serves to thereafter secure the position of the member 65 and hook 66 relative to each other. As above, the tooth is potted in resin when forming a guide device. Hence, the deformed web 72 is set against further deformation.

The invention thus provides a guide tooth with an an adjustment zone by means of which a guide device formed of a plurality of the guide teeth can be constructed to define a precise guide channel for a picking element.

The invention further provides a guide device in which very little wear of the guide teeth and a picking element may occur during use due to the very regular path of the guide channel in the device.

Of note, the guide teeth and guide device may be used for gripper projectile weaving machines as well as for band gripper weaving machines.

What is claimed is:

1. A guide device for a weft picking element of a weaving machine, said device including a plurality of aligned guide teeth defining a guide channel for the picking element, each said tooth having a guide and support member, a guide hook, a base and a zone in said base between guide and support member and said hook to permit positional adjustment of said guide and support member and said hook relative to each other.

2. A guide device for a weft picking element of a weaving machine, said device including a plurality of aligned guide teeth defining a guide channel for the picking element, each said tooth having a guide and support member, a guide hook and a base, at least some of said teeth having a flexed zone between said guide and support member and said hook thereof; and means securing each base of each tooth therein with said guide and support member and said hook of each tooth in precisely fixed relation to each other.

3. A guide device as set forth in claim 2 wherein said means is a resin block,

4. A guide device as set forth in claim 1 wherein said zone is a flexible zone of said base.

5. A guide device as set forth in claim 4 wherein said base has a recess dividing said base into two halves and extending towards said guide opening, said zone being disposed between said recess and said guide opening.

6. A guide device as set forth in claim 5 wherein each zone is a deformable web in said base bridging said recess.

7. A guide device as set forth in claim 4 wherein said base has a recess dividing said base into two halves and extending from said guide opening, said zone being disposed between said halves.

8. A guide tooth for a guide device for a weft picking element, said tooth comprising a guide and support member;

a guide hook spaced from said guide and support member to define a guide opening;

a base connecting said guide and support member and said hook together; and a deformable zone in said base to permit adjustment of said guide and suport member and said hook relation to each other and to said guide opening.

9. A guide device for a weft picking element of a weaving machine, said device including a plurality of aligned guide teeth defining a guide channel for a picking element, each said tooth having a guide and support member including a first base, a guide hook including a second base and spaced from said guide and support member to define a guide opening and means in said bases to permit positional adjustment of said guide and support member and said hook relative to each other.

10. A guide device as set forth in claim 9 which further comprises means for securing each base of each tooth therein with said member and said hook of each tooth in precisely fixed relation to each other after positional adjustment thereof.

11. A guide device as set forth in claim 10 wherein said means is a resin block.

12. A guide device as set forth in claim 9 wherein said means includes a circular rod extending through each base to define a pivot for pivoting of each of said guide and support member and said hook about said rod.

13. A guide device as set forth in claim 9 wherein said means includes a circular recess in each respective base at one end thereof and a circular rod extending through each recess to define a pivot zone for pivoting of each of said member and said hook about said rod.

14. A guide device as set forth in claim 9 wherein said means includes an articulated jointed between said bases.

15. A guide device as set forth in claim 14 wherein said joint includes a projection on one of said bases and a recess on the other of said bases receiving said projection in mating relation.

16. A guide tooth for a guide device for a weft picking element, said tooth comprising a guide and support member having a base;

a guide hook including a base and spaced from said guide and support member to define a guide opening, and an articulated joint between said bases to permit adjustment of said guide and support member and said hook relative to each other and to said guide opening.

17. A method of making a guide device for a weft picking element, said method comprising the steps of obtaining a plurality of guide teeth with each tooth having a guide and support member, a guide hook defining a guide opening with the member and a base with a deformable zone;

obtaining a gauge rod having a cross-section of a size greater than the guide opening of each respective tooth by an amount of a clearance between the guide opening and a picking element to be guided therethrough;

positioning the guide teeth and interposed spacers in alignment with the rod passing through the aligned guide openings and with each guide and support member and each hook abutting the rod;

potting the bases of the aligned guide teeth in a resin;

curing the resin; and thereafter removing the rod.

18. A method as set forth in claim 17 wherein each guide tooth includes a recess in said base extending from the guide opening to divide the base into two halves and which further comprises the step of introducing a wedge into each recess after positioning of the rod to fix the position of the guide and support member and hook of each tooth relative to each other.

* * * * *